United States Patent [19]

Kehrer et al.

[11] Patent Number: 5,031,692

[45] Date of Patent: Jul. 16, 1991

[54] HEAT EXCHANGER FOR COOLING CRACKED GAS

[75] Inventors: Wolfgang Kehrer; Thomas Schreck, both of Berlin, Fed. Rep. of Germany

[73] Assignee: Borsig GmbH, Berlin, Fed. Rep. of Germany

[21] Appl. No.: 514,155

[22] Filed: Apr. 25, 1990

[30] Foreign Application Priority Data

Apr. 26, 1989 [DE] Fed. Rep. of Germany ..... 3913731

[51] Int. Cl.[5] ..... C10G 9/16; F28F 13/08

[52] U.S. Cl. ..... 165/134.1; 165/903; 122/7 R; 208/48 R; 585/950

[58] Field of Search ..... 165/147, 903, 134.1; 208/48 Q, 48 R; 585/950; 122/7R

[56] References Cited

U.S. PATENT DOCUMENTS

| | | | |
|---|---|---|---|
| 1,948,541 | 2/1934 | Noack | 165/147 |
| 2,740,803 | 4/1956 | Dorschner | 165/147 |
| 4,248,834 | 2/1981 | Tokumitsu | 208/48 Q |
| 4,279,734 | 7/1981 | Gwyn | 208/48 Q |
| 4,405,440 | 9/1983 | Gwyn | 208/48 Q |

*Primary Examiner*—Albert W. Davis, Jr.
*Attorney, Agent, or Firm*—Max Fogiel

[57] ABSTRACT

A heat exchanger for cooling cracked gas has a nest of heat-exchange tubes (1) that the gas flows through and that are secured at the ends in bases (2 and 3) and surrounded by a jacket (4) that demarcates in conjunction with the bases a chamber occupied by evaporating water. Each heat-exchange tube has two sections (10 and 11) that differ in diameter and communicate through a cone (12). The section (11) with the longest diameter is at the emerging-gas end of the heat-exchange tube.

5 Claims, 1 Drawing Sheet

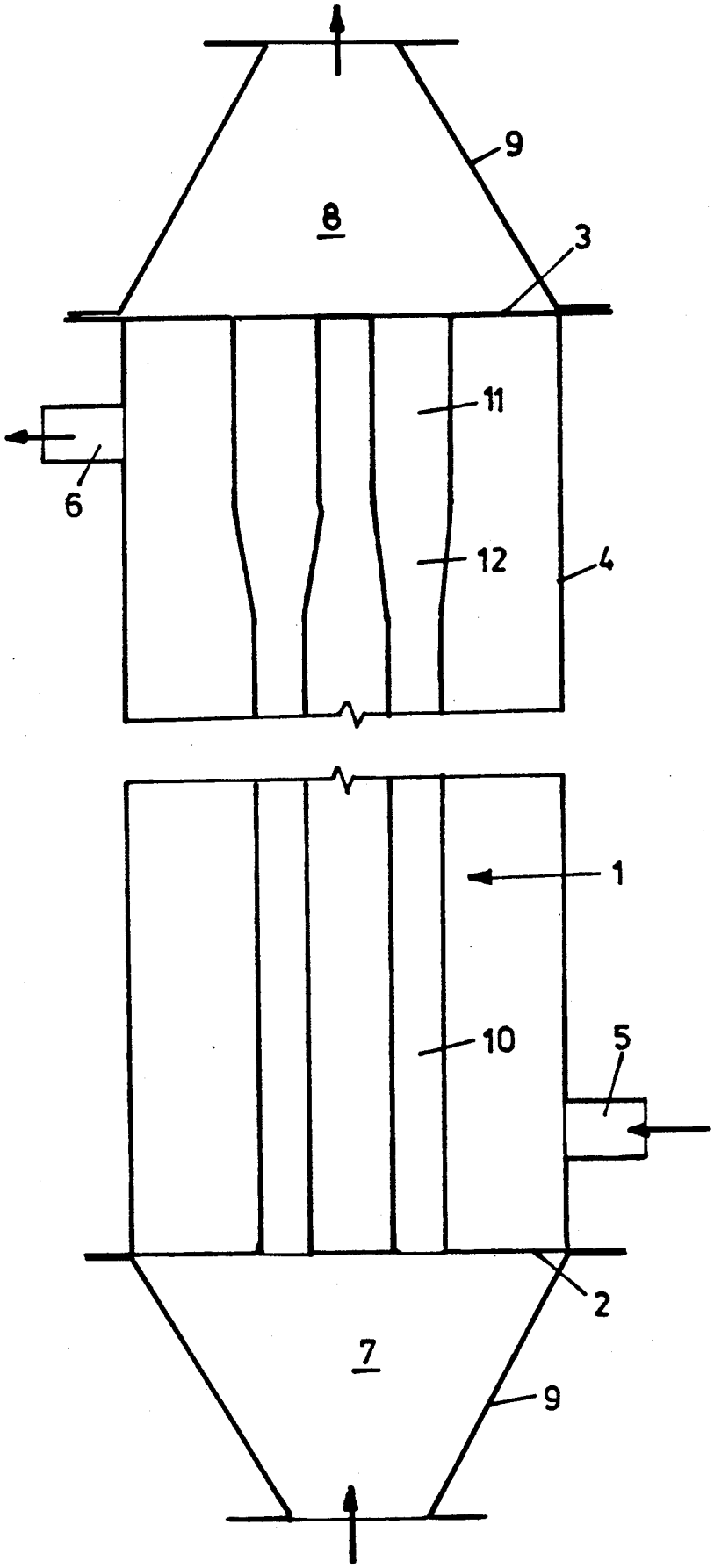
9
8
3
11
6
12
4
1
10
5
2
7
9

HEAT EXCHANGER FOR COOLING CRACKED GAS

BACKGROUND OF THE INVENTION

The invention concerns a heat exchanger for cooling cracked gas.

cracked gas, which is generated by thermally cracking hydrocarbons accompanied by the addition of steam, is a mixture of hydrocarbons that differ in molecular weight and partial pressure. To stabilize its molecular composition the gas must be cooled very rapidly from approximately 800°-900° C. to 600°-650° C. The gas is cooled by transferring its heat indirectly to the steam, which acts as a head-absorbing fluid. To maintain the high cooling rate the gas must flow through the heat-exchange tube very rapidly. Atlhough the gas is further cooled from 600°-650° C. depending on the material, the sole purpose of the procedure is to recover heat, and it has little effect on the quality of the gas. This secondary cooling can occur at lower flow rates.

In addition to sufficiently rapid cooling, the gas-end pressure in the tubes in the gas furnace and gas cooler also affects the quality of the resulting gas. A slight loss of pressure in the cooler for example results in lower pressure in the furnace, which increases the yield of ethylene. An attempt is accordingly made in practice to optimize between the rate of flow and the loss of pressure in the flowing gas.

Nested-tube heat exchangers that cool the gas from 800° C. to 400° C. in one draft are employed as cracked-gas coolers. A correspondingly low rate of flow is maintained in the heat-exchanger tubes. Although a heat exchanger of this type is simple in design, the rate of cooling is sometimes too low, especially at the intake, to stabilize the gas at the desired composition.

Two-stage heat-exchanger systems are also known. They are usually single-pipe coolers and cool the gas at a higher flow rate from 800° C. to 500° C. Downstream of these coolers is a separate heat exchanger wherein the gas is cooled to 400° C. at a lower flow rate. Systems of this type cost considerably more.

Finally, the tendency of a heat-exchange tube to become dirty, a tendency that is related to pressure and temperature, must also be taken into consideration. Such contamination occurs when the temperature of individual gas constituents drops below condensation temperature, which depends on partial pressure, and they precipitate on the inner surface of the tube. The result is what is called a coke bed, which increases flow resistance and hence pressure. The temperature of the gas at the exit end increases and less steam is generated. After a certain number of hours of operation, accordingly, the cooler must be stopped to remove the coke bed.

Maintaining the temperature of the tube wall at or above the condensation temperature of the gas constituents in order to decelerate the formation of a coke bed is known. This can be done for example by a two-stage cooling wherein evaporating water is employed as a heat-exchange fluid at the intake and steam at the outlet or in a separate device (German Patent 3 643 801). Decreasing the cooling at the outlet from a cracked-gas cooler by jacketing the outlet end of the heat-exchange tube and allowing a limited amount of evaporating water to flow through the jacket is also known (German Patent 3 715 713).

SUMMARY OF THE INVENTION

The object of the invention is to improve a generic heat exchanger for cooling cracked gas in such a way as to retain the simplicity of equipment of single-stage cooling along with the advantages of two-stage cooling with variable flow rates.

The short diameter at the intake end of this heat exchanger makes it possible to establish a flow that is rapid enough to rapidly cool the gas. A coke bed is allowed to form at the gas-outlet end, where the diameter of the tube is longer and the operation of the cooler will accordingly be affected less. The flow resistance and the temperature of the emerging gas will not, due to the longer diameter, be as high as they would in a narrower tube. A desirable side effect of the decelerated flow in the conical tube section is the recovery of part of the gas's static pressure.

BRIEF DESCRIPTION OF THE DRAWINGS

A schematic longitudinal section through a heat exchanger.

DESCRIPTION OF THE PREFERRED EMBODIMENTS

The illustrated heat exchanger is positioned downstream of gas-cracking furnace and its purpose is to cool the resulting gas. The heat exchanger contains a nest of heat-exchange tubes 1, only two of which are, for simplicity's sake, illustrated. The tubes are inserted at each end into a base 2 and 3. Bases 2 and 3 are secured to a jacket 4 that surrounds heat-exchange tubes 1. Jacket 4 has an intake 5 for supplying it with a heat-exchange fluid and an outlet 6 for removing the fluid. The fluid is evaporating water.

Heat-exchange tubes 1 connect a gas-intake chamber 7 with a gas-outlet chamber 8. The two chambers are demarcated by a hood 9 and a base 2 or 3. The gas cracked in the furnace is supplied to gas-intake chamber 7.

Each heat-exchange tube 1 has two sections 10 and 11 that communicate through a cone 12. The cone tapers at an angle of preferably 6° to 8°. The diameter of section 10, which faces gas-intake chamber 7, is shorter than that of section 11, which is at the emerging-gas end. The diameter of section 10 can for example be 31 or 38 mm and that of section 11 can be 42, 48, or 51 mm for example. If the wall of heat-exchange tube 1 is 3 or 5 mm thick, the free cross-section will increase from 1 to between 1.6 and 1.8 in the illustrated example. Generally, the cross-section should increase from 1 to between 1.5 and 2.0.

We claim:

1. A heat exchanger for cooling cracked gas comprising: a nest of heat-exchanging tubes for conducting cracked gas to be cooled therethrough, each of said heat-exchanging tubes having two ends; a supporting base member at each end of said tubes; a jacket surrounding said tubes and forming a chamber with the supporting bases at said ends, said chamber being occupied by evaporating water; an evaporating water inlet and an evaporating water outlet communicating on said jacket for circulating evaporating water through said chamber; each heat-exchanging tube having two sections with different diameters; a conical transition member connecting said two sections; a gas intake chamber formed with one base member at one end of said tubes; a gas outlet chamber formed with the other base member at the other end of said tubes; one section of said heat-exchanging tubes communicating with said intake chamber and the other section of said heat-exchanging tubes communicating with said outlet chamber, said other section of said tubes having a diameter larger than the diameter of said one section of said tubes communicating with said intake chamber.

2. A heat exchanger as defined in claim 1, wherein a ratio of the diameter of said tube sections communicating with said intake chamber to the diameter of said tube sections communicating with said outlet chamber is between 1/1.5 and 1/2.0.

3. A heat exchanger as defined in claim 1, wherein a ratio of the diameter of said tube sections communicating with said intake chamber to the diameter of said tube sections communicating with said outlet chamber is between 1/1.6 and 1/1.8.

4. A heat exchanger as defined in claim 1, wherein said conical transition member has a taper of $6^0$ to $8^0$.

5. A heat exchanger for cooling cracked gas comprising: a nest of heat-exchanging tubes for conducting cracked gas to be cooled therethrough, each of said heat-exchanging tubes having two ends; a supporting base member at each end of said tubes; a jacket surrounding said tubes and forming a chamber with the supporting bases at said ends, said chamber being occupied by evaporating water; and evaporating water inlet and an evaporating water outlet communicating on said jacket for circulating evaporating water through said chamber; each heat-exchanging tube having two sections with different diameters; a conical transition member connecting said two sections; a gas intake chamber formed with one base member at one end of said tubes; a gas outlet chamber formed with the other base member at the other end of said tubes; one section of said heat-exchanging tubes communicating with said intake chamber and the other section of said heat-exchanging tubes communicating with said outlet chamber, said other section of said tubes having a diameter larger than the diameter of said one section of said tubes communicating with said intake chamber; a ratio of the diameter of said sections communicating with said intake chamber to the diameter of said sections communicating with said outlet chamber being between 1/1.5 to 1/2.0; said conical transition member having a taper of $6^0$ to $8^0$.

* * * * *